United States Patent [19]

Crisp

[11] Patent Number: 4,864,668

[45] Date of Patent: Sep. 12, 1989

[54] PORTABLE BACK SUPPORT

[76] Inventor: David Crisp, 280 Simcoe Street, PH5A, Toronto, Ontario, Canada, M5T 2Y5

[21] Appl. No.: 326,642

[22] Filed: Mar. 21, 1989

[51] Int. Cl.[4] ..... A47C 20/02

[52] U.S. Cl. ..... 5/432; 5/490; 128/70; 297/229; 297/231; 297/457

[58] Field of Search ..... 5/432, 431, 433, 490; 128/70; 297/230, 231, 460, 229, 457; D6/601; D24/64

[56] References Cited

U.S. PATENT DOCUMENTS

| | | | |
|---|---|---|---|
| D. 251,985 | 5/1979 | Martin | D6/502 |
| D. 294,319 | 2/1988 | Troup et al. . | |
| 1,650,130 | 11/1927 | Joachim . | |
| 1,659,405 | 2/1928 | Love | 297/457 |
| 1,842,424 | 1/1932 | Ponten et al. . | |
| 1,882,485 | 10/1932 | Clements . | |
| 2,939,518 | 6/1960 | Krone et al. . | |
| 3,346,298 | 10/1967 | Champion | 297/231 |
| 3,501,197 | 3/1970 | Burton . | |
| 3,600,035 | 8/1971 | Vondrejs | 297/230 |
| 3,974,827 | 8/1976 | Bodeen | 128/70 |
| 4,350,152 | 9/1982 | Strakowski | 5/431 |
| 4,556,254 | 12/1985 | Roberts | 297/460 |
| 4,597,386 | 7/1986 | Goldstein | 5/432 |

*Primary Examiner*—Alexander Grosz
*Attorney, Agent, or Firm*—Ridout & Maybee

[57] ABSTRACT

A portable back support having a insert enveloped by a sleeve, forming a cushioned rigid portion and a flexible flap. The back support is dimensioned to support the lumbar and much of the thoracic regions of the spine and is narrower than the distance between a user's scapula. The back support is thus considerably easier to transport and less inconspicuous in use than known portable back supports.

9 Claims, 2 Drawing Sheets

PORTABLE BACK SUPPORT

FIELD OF THE INVENTION

This invention relates to portable back supports. In particular, this invention relates to a lightweight, portable back support.

BACKGROUND OF THE INVENTION

Back supports are a popular means of alleviating and preventing chronic back pain, particularly pain in the lower back about the lumbar region of the spine. In recent years portable back supports adapted to rest against a seat back have become increasing popular, providing a convenient means for relief from lower back pain in settings which are not practical for the provision of non-portable therapeutic back support devices.

Known portable back supports for alleviating back pain and promoting correct posture have heretofore been designed to support a large portion of the back of the user. Typically such back supports extend as high as the scapula and the full breadth of an average user's back, and in some cases additionally provide lateral support extensions to support the sides of the user, offering various configurations and features to achieve this end. As a result, such back supports tend to be large and bulky, and while they are portable in the sense that they are relatively lightweight and can thus be moved from one location to another with relative ease, they are rather conspicuous in use and too large to be concealed or conveniently accommodated during transfer in an ordinary carrying bag or briefcase.

The present invention provides a novel portable back support which overcomes these disadvantages by being designed to support only that portion of the user's back which is in most cases required to be supported to improve posture and alleviate stress on the spinal column and surrounding muscles. In most cases, chronic back pain tends to be concentrated in the lower back, about the lumbar region of the spine, and it has been found that a back support adapted to support the portion of the back immediately about the lumbar and lower thoracic regions of the spine can in many cases effectively improve posture and alleviate lower back pain, without the need to support the entire breadth of a user's back.

To maintain a back support of the present invention in position during use, a flexible flap is provided which resists lateral shifting of the back support under the weight of the user. The flexible flap further resists forward slippage of the user, which can promote incorrect posture.

In result, the back support of the present invention is considerably smaller than known back supports, and is thus not only much less conspicuous in use it can easily be stored for transfer in an ordinary briefcase or handbag. It is thus better suited for use in restaurants, airplanes, etc. where use of a known back support might be awkward or prohibited, or might tend to make the user feel conspicuous or otherwise call unwelcome attention to the user. It is also easier to transport from place to place during the user's daily activities.

SUMMARY OF THE INVENTION

The present invention thus provides a portable back support comprising an insert having a substantially rigid backing and a resilient cushion, and a flexible sleeve having a length substantially greater than the length of the insert wherein the insert is retained in the sleeve such that a portion of the sleeve extends beyond the insert forming a flexible flap.

BRIEF DESCRIPTION OF THE DRAWINGS

In drawings which illustrate by way of example only a preferred embodiment of the subject invention.

DETAILED DESCRIPTION OF THE INVENTION

Figure 2:
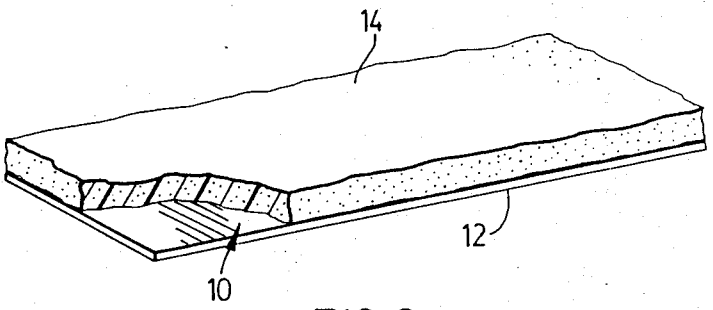
FIG. 2 is a perspective view of an insert for the back support of FIG. 1.

In a preferred embodiment of a back support 2 of the present invention support is provided by an insert 10, illustrated in FIG. 2, comprising a substantially rigid backing 12 cut from a sheet of plexiglass or plywood or other substantially rigid lightweight material, and a resilient cushion 14 preferably composed of urethane foam or other suitable durable resilient material.

The resilient cushion 14 is preferably generally congruent with the rigid backing 12. The thickness of the rigid backing 12 should be such that it will retain its shape under the weight of the user while being relatively lightweight, preferably in the order of one-quarter inch (6.35 millimeters). The thickness of the resilient cushion 14 is preferably approximately one inch (25.4 millimeters) of a medium firm foam, which will protect the user's back from contact with the rigid backing and provide compressive support, and yet not render the thickness of the insert 10 so great that it overcompensates for posture deficiencies or renders the back support 2 uncomfortable in use.

The length of the insert 10 may range from approximately 9 inches (23 centimeters) to 15 inches (38 centimeters), sufficient to support the lumbar and lower thoracic regions of the spine, preferably about 14.5 inches (37 centimeters). The width of the insert 10 may range from approximately 2.5 inches (6 centimeters) to 5.5 inches (14 centimeters), narrower than the distance between a user's scapula, preferably about 4.5 inches (11.5 centimeters).

Figure 3:
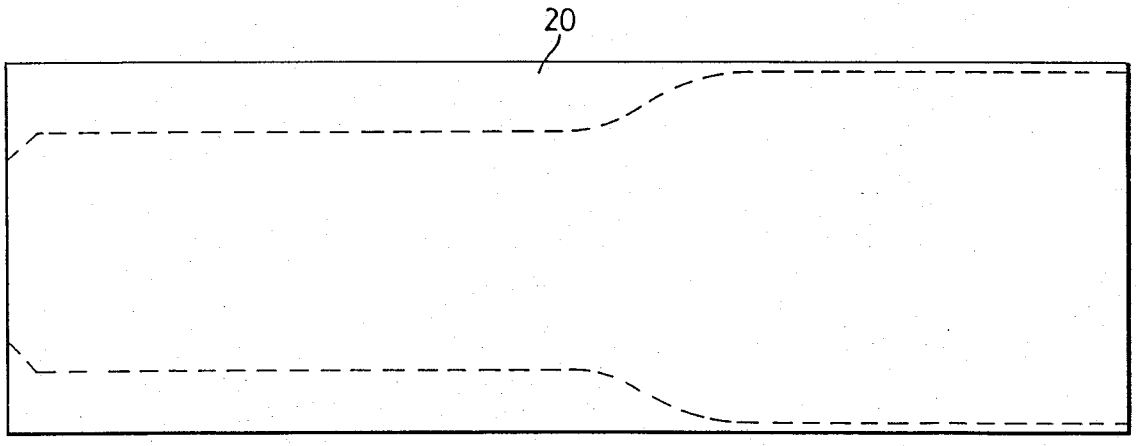
FIG. 3 is a plan view of a pattern for a sleeve for the back of FIG. 1.

A sleeve 16 is preferably composed of a lightweight durable fabric, such as a cotton or synthetic blend, with relatively low elasticity. The sleeve 16 may be formed from two identical fabric panels 20 one of which is illustrated in FIG. 3, sized to the dimensions of the insert, in the case of the insert described above approximately 30 inches (75 centimeters) in length by 8 to 9 inches (20 to 23 centimeters) in width.

The edges of the fabric are preferably sewed or joined in any other suitable manner to form a sleeve 16 adapted to snugly envelop the insert 10 along the length of the insert 10. The sleeve 16 should be closed at one end 18 to assist in retaining the insert 10 and for aesthetic reasons. FIG. 3 illustrates a preferred pattern for joining the two panels of the sleeve 16, for reasons described below.

The sleeve 16 may be formed around the insert 10, or preferably the insert 10 will be inserted after formation of the sleeve 16, by known means. In the latter case, with one end 18 of the sleeve 16 is closed, by grasping one end of the insert 10 at the closed end 18 of the sleeve 16 and drawing the open end of the sleeve 16 over and past the insert 10 like a sock, the sleeve 16 will be turned inside out so that seams are inside the sleeve 16 and the insert 10 will be snugly retained at the closed end 18 of the sleeve 16. Alternatively, the insert 10 may be inserted into the open end and worked toward the closed end 18 of the sleeve. In either case the insert 10 will be retained by the snug fit of the cushion 14 within the fabric and friction between the fabric of the sleeve 16 and the insert 10.

It can be seen that, although the cushion 14 may be affixed to the rigid backing 12, this is not generally necessary if the sleeve 16 is designed to snugly envelope the insert 10. The back support 2 thus produced comprises a rigid portion 4, along the length of the insert 10, and a flexible flap 6 extending beyond the insert 10, preferably approaching the length of the rigid portion 4.

The sleeve 16 is preferably formed such that its inner cross-sectional area along the rigid portion 4 of the back support 2 is slightly less than that along the flap 6, by stitching the seams between the two pieces of fabric 20 along the phantom lines shown in FIG. 3. The edges of the fabric may be trimmed as required. It will be seen that by forming the sleeve 16 as illustrated in FIG. 3 insertion of the insert 10 is facilitated since the flap 6 will not snugly surround and thus impede insertion of the insert 10. This is particularly advantageous to washability and replacement of the sleeve 16. The increased breadth of the flap 6 also assists in resisting lateral shifting of the back support 2 and forward slippage of the user, as described below.

Figure 1:
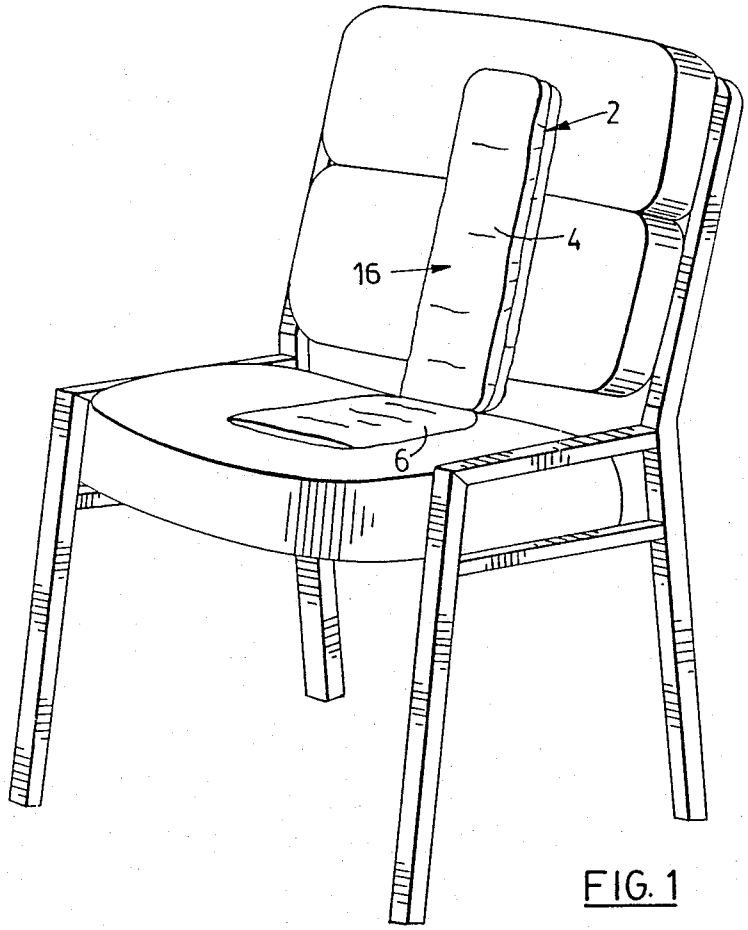
FIG. 1 is a perspective view of a back support embodying the subject invention in position for use on a chair.

In use, the user places the back support 2 on a chair, car seat or other seat having a back, standing the rigid portion 4 of the back support 2 upright such that the cushion 14 faces forwardly, with the flexible flap 6 splayed forwardly along the seat, as illustrated in FIG. 1. When the user is seated, the force of his or her back resting against the seat back will retain the rigid portion 4 of the back support 2 in upright position, and lateral shifting of the back support 2 is resisted thereby and by the weight of the user on the flexible flap 6 of the back support 2. Conversely, the tendency of a user to slip forwardly on a seat, particularly one with a smooth surface, is resisted by the weight of the user on the flexible flap 6, a relatively high-friction surface, and the force of the user against the rigid portion 4.

The back support 2 can be adjusted by the user for comfort by pulling the flap 6 forwardly to alter the incline of the rigid portion 4 against the seatback. In this manner the rigid portion may be brought firmly against the lower back for maximum benefit. The flap 6 may be simply folded out of the way if not needed.

The back support 2 thus positioned conforms generally to the shape of the user's lower back while urging the lumbar and lower thoracic spine forwardly to promote correct posture and alleviate and prevent chronic lower back pain. It can further be seen that, when in use, the back support 2 of the present invention will be substantially or totally concealed by the user's body and is thus quite inconspicuous.

Figure 4:
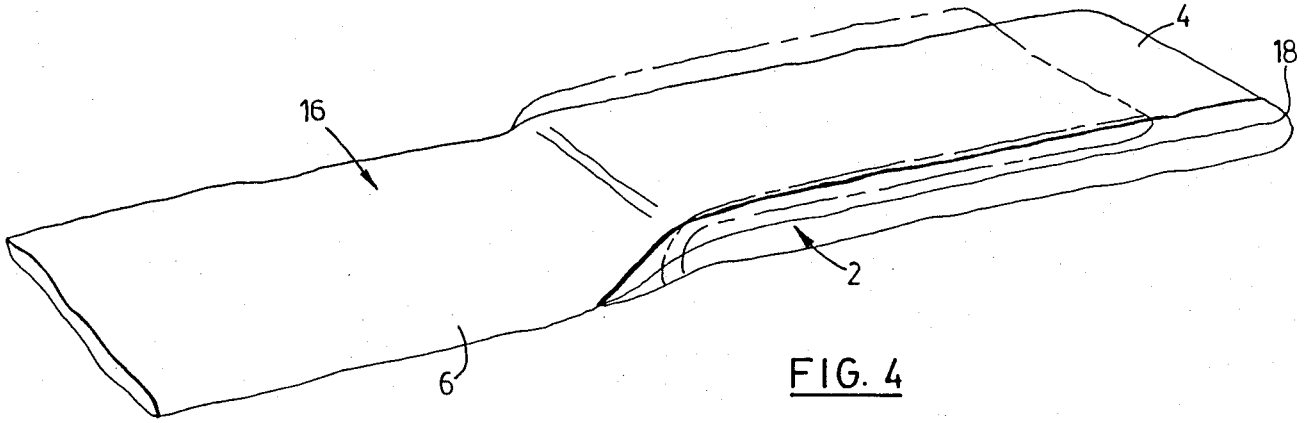
FIG. 4 is a perspective view of the back support of FIG. 1 indicating one manner of folding the flexible flap for portability in phantom lines.

The back support 2 may easily be stowed in a briefcase or carrying case by simply folding the flexible flap 6 over the rigid portion 4 of the back support 2, as illustrated in phantom lines in FIG. 4, such that the back support 2 effectively assumes a volume only slightly larger than the volume of the rigid portion 4 itself.

Having described by way of example only a preferred embodiment of the subject invention, it will be obvious to those skilled in the art that certain adaptations and modifications may be made without departing from the scope of the invention. It is intended to include all such adaptations and modifications as fall within the scope of the appended claims.

I claim:

1. A portable back support adapted for use by a sitting user comprising an insert having a substantially rigid backing and a resilient cushion, and a, flexible sleeve having a length substantially greater than the length of the insert, wherein the insert is retained in the sleeve such that a portion of the sleeve extends beyond the insert forming a flexible flap of a sufficient size to permit the user to sit thereon, thereby anchoring the insert in a vertical position behind the user's spinal column, said insert having a length ranging from approximately 9 to 15 inches and width ranging approximately from 2.5 to 5.5 inches.

2. The portable back support defined in claim 1 wherein the rigid backing is composed of plexiglass or wood or other substantially rigid material.

3. The portable back support defined in claim 2 wherein the rigid backing has a thickness of approximately one-quarter of an inch.

4. The portable back support defined in claim 1 wherein the resilient cushion is substantially congruent with the rigid backing.

5. The portable back support defined in claim 4 wherein the resilient cushion is comprised of a resilient foam of medium firmness.

6. The portable back support defined in claim 1 wherein the sleeve is composed of a substantially nonelastic fabric.

7. The portable back support defined in claim 1 wherein the length of the insert is approximately 14.5 inches.

8. The portable back support defined in claim 1 wherein the width of the insert is less than the distance between a user's scapula.

9. The portable back support define in claim 1 wherein the width of the insert is approximately 4.5 inches.

* * * * *